US008593496B2

(12) United States Patent
Ishikawa et al.

(10) Patent No.: US 8,593,496 B2
(45) Date of Patent: Nov. 26, 2013

(54) LIGHT EMITTING PANEL, OPTICAL PRINT HEAD, AND IMAGE FORMING APPARATUS

(75) Inventors: Daisuke Ishikawa, Shizuoka-ken (JP); Koji Tanimoto, Shizuoka-ken (JP); Kenichi Komiya, Kanagawa-ken (JP); Kazutoshi Takahashi, Shizuoka-ken (JP); Hiroyuki Ishikawa, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 85 days.

(21) Appl. No.: 13/236,998

(22) Filed: Sep. 20, 2011

(65) Prior Publication Data

US 2012/0081497 A1 Apr. 5, 2012

Related U.S. Application Data

(60) Provisional application No. 61/389,707, filed on Oct. 4, 2010.

(51) Int. Cl.
*B41J 2/45* (2006.01)

(52) U.S. Cl.
USPC ..... 347/238

(58) Field of Classification Search
USPC ..... 347/122, 128, 130, 132, 238, 241, 242, 347/256, 257
See application file for complete search history.

(56) References Cited

U.S. PATENT DOCUMENTS 6,332,269 B1 * 12/2001 Gamel et al. ..... 29/833
7,486,306 B2 * 2/2009 Tsujino et al. ..... 347/224

OTHER PUBLICATIONS

U.S. Appl. No. 13/073,468, filed Mar. 28, 2011.
U.S. Appl. No. 13/072,404, filed Mar. 25, 2011.

* cited by examiner

*Primary Examiner* — Hai C Pham
(74) *Attorney, Agent, or Firm* — Patterson & Sheridan, LLP

(57) ABSTRACT

In general, according to the embodiment, a light emitting panel includes a glass substrate, a light emitting element, metal wiring, and a mark. The glass substrate allows light to pass through. The light emitting element is present in any one of a first plane and a second plane which is a rear surface of the first plane, of the glass substrate. The metal wiring is present on one surface, and applies voltage to the light emitting element. The mark is present on one surface, and is formed of the same material as the metal wiring.

17 Claims, 8 Drawing Sheets

LIGHT EMITTING PANEL, OPTICAL PRINT HEAD, AND IMAGE FORMING APPARATUS

CROSS-REFERENCE TO RELATED APPLICATION

This application is based upon and claims the benefit of priority from U.S. provisional application 61/389,707, filed on Oct. 4, 2010; the entire contents of which are incorporated herein by reference.

FIELD

Embodiments described herein relate generally to a light emitting panel, an optical print head, and an image forming apparatus.

BACKGROUND

In the related art, a light emitting panel in which a light emitting element such as an EL (Electro Luminescence), or the like is provided on a substrate, is used. In this light emitting panel, there is a problem in that it is difficult to understand which surface is an emitting surface of the light emitting element, and workability is not good when attaching the light emitting panel to other units, in a manufacturing process.

DETAILED DESCRIPTION

In general, according to one embodiment, a light emitting panel includes a glass substrate, a light emitting element, metal wiring, and a mark. Light passes through the glass substrate. The light emitting element is present on any one of a first plane and a second plane which is a rear surface of the first plane of the glass substrate. The metal wiring is present on one plane, and applies voltage to the light emitting element. The mark is present on one plane and is formed of the same material as that of the metal wiring.

Hereinafter, each embodiment will be described with reference to drawings.

First Embodiment

Figure 1:
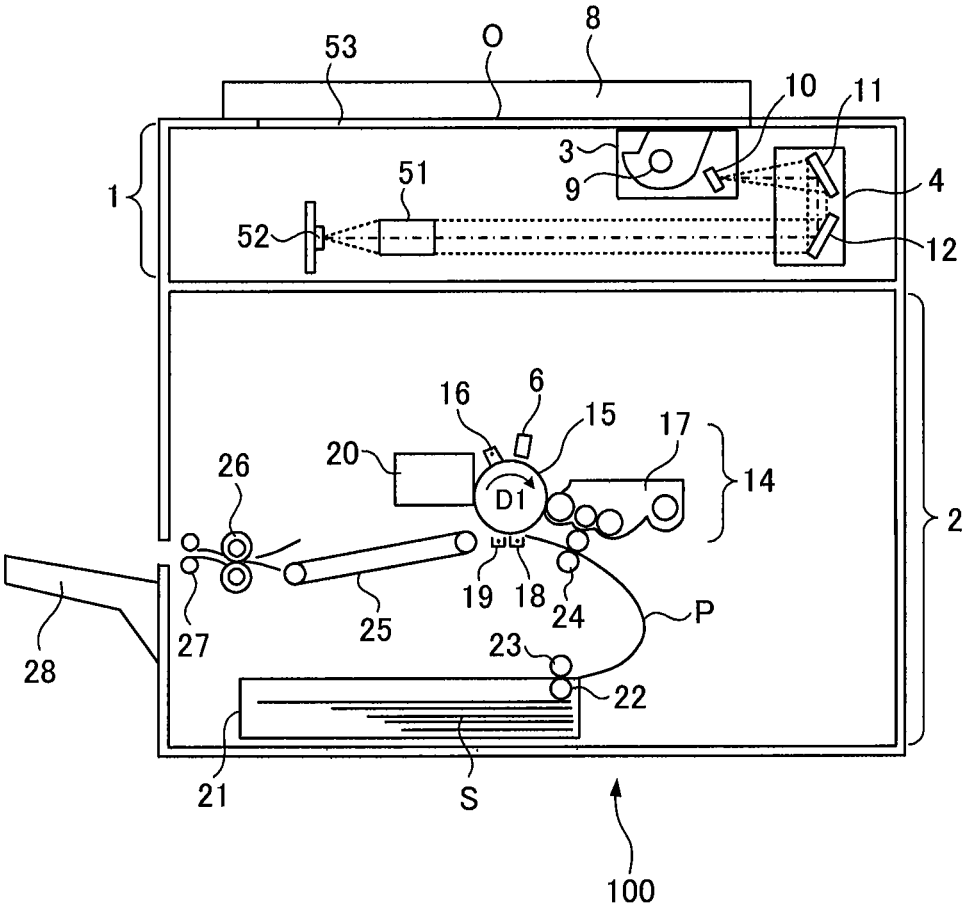
FIG. 1 is a diagram which illustrates an internal configuration of an image forming apparatus.

FIG. 1 is a diagram which illustrates an internal configuration of an image forming apparatus 100.

The image forming apparatus 100 includes a scanner unit 1 which reads an image of an original document O, and a printer unit 2 which forms an image on a sheet S (a member to be transferred). In the scanner unit 1, a first carriage 3 which supports a light source 9 and a mirror 10 and a second carriage

4 which supports mirrors 11 and 12, move independently of each other in a horizontal direction of FIG. 1, and maintain the length of an optical path from the original document O to a photoelectric conversion element 52 so as to be constant. Light, which is emitted from the light source 9 and is reflected to the original document O through a document table glass 53, is image-formed on the photoelectric conversion element 52 through the mirrors 10, 11 and 12, and a condensing lens 51, after passing through the document table glass 53 again. The photoelectric conversion element 52 outputs an image signal to an optical print head 13 of the print unit 2. In this manner, the scanner unit 1 sequentially reads an image of the original document O for each one line in the direction perpendicular to the plane of FIG. 1.

In the printer unit 2, a sheet S in a sheet feeding cassette 21 is conveyed to an image forming unit 14 through a sheet feeding roller 22, a separating roller 23, a conveying path P, and a resist roller 24. The image forming unit 14 forms an image on the sheet S. Specifically, a photoconductive drum 15 of the image forming unit 14 rotates in a direction of an arrow D1. A charger 16 charges a surface of the photoconductive drum 15. An optical print head 6 scans the photoconductive drum 15 in a main scanning direction (in the direction perpendicular to the plane of FIG. 1), and forms an electrostatic latent image on the photoconductive drum 15. A developing unit 17 develops the electrostatic latent image on the photoconductive drum 15 by supplying toner, and forms a toner image on the photoconductive drum 15. A transfer charger 18 transfers the toner image to the sheet S, whereby an image is formed on the sheet S. A separating charger 19 separates the sheet S from the photoconductive drum 15. A cleaner 20 removes toner remaining on the photoconductive drum 15. The sheet S on which the image is formed using the image forming unit 14, is conveyed to a fixer 26 using a conveying mechanism 25. The sheet is heated and pressurized in the fixer 26, and then is discharged to a discharge tray 28 using a discharging roller 27.

Figure 2:
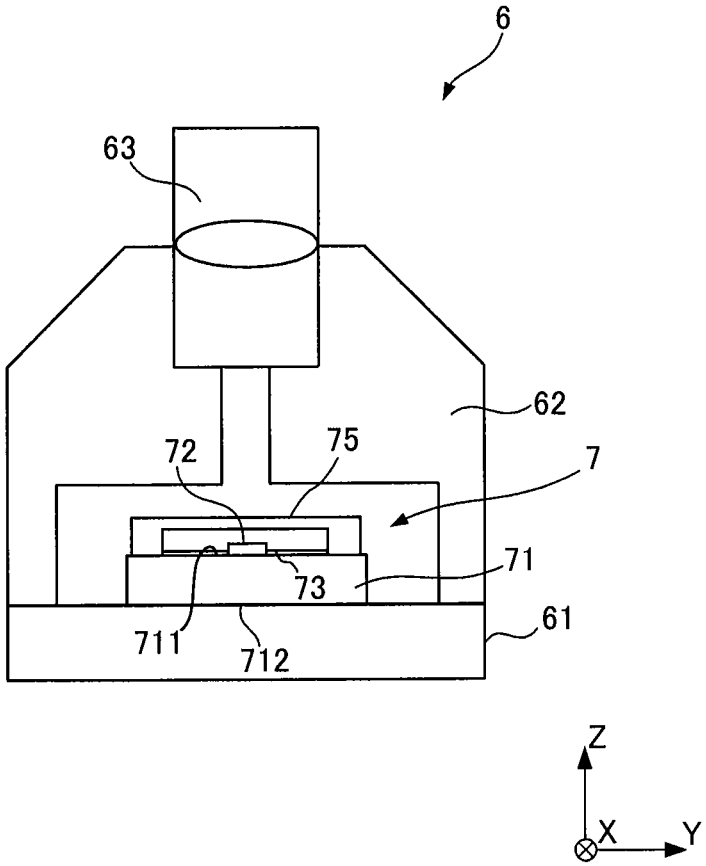
FIG. 2 is a cross-sectional diagram of an optical print head.

FIG. 2 is a cross-sectional diagram of the optical print head 6. In FIG. 2, X, Y, and Z axes are orthogonal to each other.

The optical print head 6 extends in the depth direction with respect to the plane of FIG. 2, emits light for one line, and exposes the photoconductive drum 15 for each one line. The optical print head 6 includes an attachment base 61, a lens holder 62, a SELFOC lens array 63, and a light emitting panel 7.

The attachment base 61 holds the light emitting panel 7. The light emitting panel 7 includes a plurality of light emitting elements 72 in the depth direction with respect to the plane of FIG. 2.

The lens holder 62 holds the SELFOC lens array 63, and positions the SELFOC lens array 63 with respect to the light emitting panel 7.

The SELFOC lens array 63 includes a plurality of SELFOC lenses corresponding to each light emitting element 72, in the depth direction with respect to the plane of FIG. 2. The SELFOC lens array 63 allows light from each light emitting element 72 to be image-formed on the photoconductive drum 15 as spot light with a necessary resolution, using each SELFOC lens.

Figure 3:
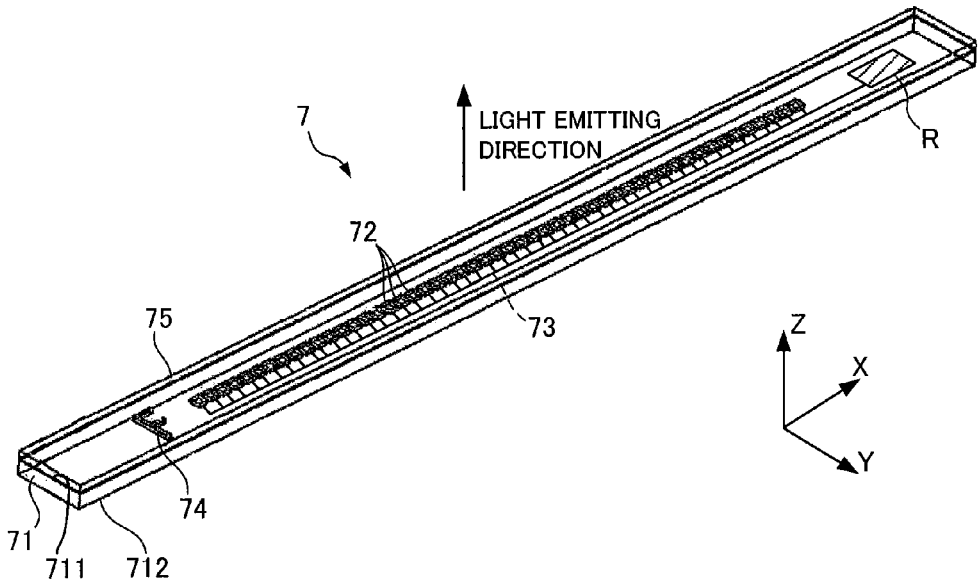
FIG. 3 is a perspective view of a light emitting panel.

FIG. 3 is a perspective diagram of the light emitting panel 7.

The light emitting panel 7 includes a glass substrate 71, the light emitting element 72, a metal wiring 73, a mark 74, and a sealing panel 75.

The glass substrate 71 has an elongated shape and is formed of transparent glass which allows light to pass thorough.

The plurality of light emitting elements 72 is continuously provided in line in a longitudinal direction of the glass substrate 71 on a front surface 711 (a first surface) of the glass substrate 71. The light emitting elements 72 are Organic Electro Luminescence elements. The light emitting elements 72 are a top emission-type, and, when a voltage is applied thereto, emit light to an upper middle side in FIG. 3, without passing through the glass substrate 71. In the glass substrate 71, a plane to which light is emitted is set to the front surface 711, and a plane to which light is not emitted is set to a rear surface 712 (a second surface).

The metal wiring 73 is formed on the front surface 711 of the glass substrate 71. In FIG. 3, a part of the metal wiring 73 is schematically shown. An appropriate material may be adopted as a material of the metal wiring 73. For example, copper may be adopted as the material. A region R for connecting an external wiring is formed on one end of the glass substrate 71 in a longitudinal direction, on the front surface 711 of the glass substrate 71. The metal wiring 73 is connected to the region R, and applies voltage to each light emitting element 72.

The mark 74 is positioned to be separated on the other end side of the glass substrate 71 in a longitudinal direction, with respect to the plurality of the light emitting elements 72 on the front surface 711 of the glass substrate 71. The mark 74 is formed of the same material as that of the metal wiring 73, and is visible from the outside of the light emitting panel 7. The formation of the mark 74 is performed at the same time and with the same material as the metal wiring 73, in the process of forming the metal wiring 73 on the glass substrate 71.

Figure 4:
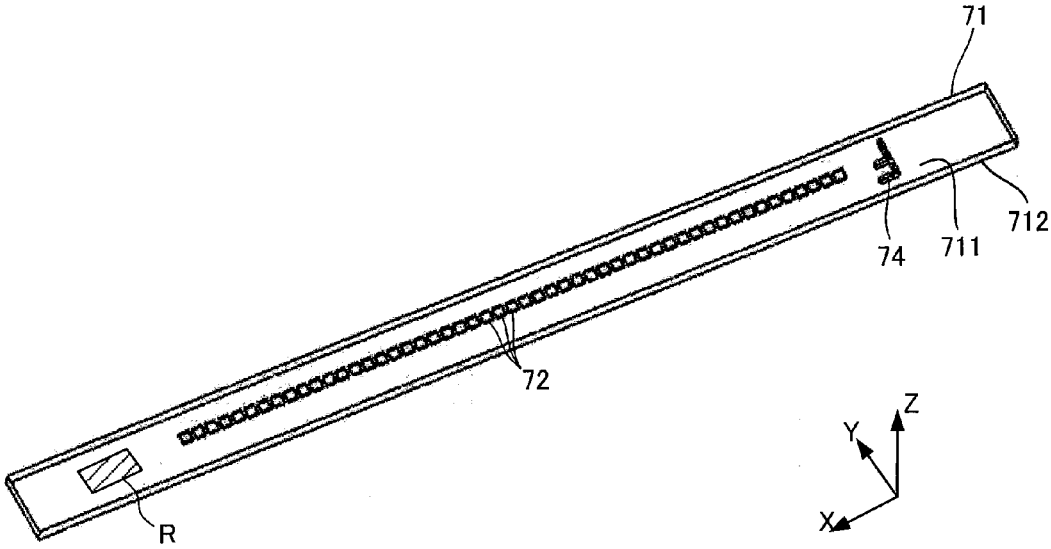
FIG. 4 is a perspective view of a glass substrate of which both ends in a longitudinal direction are conversely positioned compared to that in FIG. 3.

The mark 74 is visible from any side of the front surface 711 and the rear surface 712 of the glass substrate 71. The mark 74 allows a worker to recognize which plane is the front surface 711 and which is the rear surface 712 of the glass substrate 71, when the worker views the mark 74. The mark 74 is, for example, formed of a character F, and is asymmetric both vertically and horizontally. As shown in FIG. 3, the mark 74 has a meaningful shape (a normal posture), when seen from a side where the mark 74 is present, in the glass substrate 71, and the worker recognizes the plane 711 in which the mark 74 has the meaningful shape is the front surface 711. As shown in FIG. 4, the mark 74 reminds the worker of the fact that the mark 74 has a meaningful shape, when the worker set the posture of the glass substrate 71 to a state in FIG. 3 from the state of FIG. 4, even when the posture of the glass substrate 71 in FIG. 3 is changed to a posture in which both ends in a longitudinal direction are reversed, without being turned inside out. Accordingly, the mark 74 allows the worker to recognize that the plane 711 in which the mark 74 has a meaningful shape, is the front surface 711, and to recognize whether both ends of the glass substrate 71 in a longitudinal direction are at a correct position.

Figure 5:
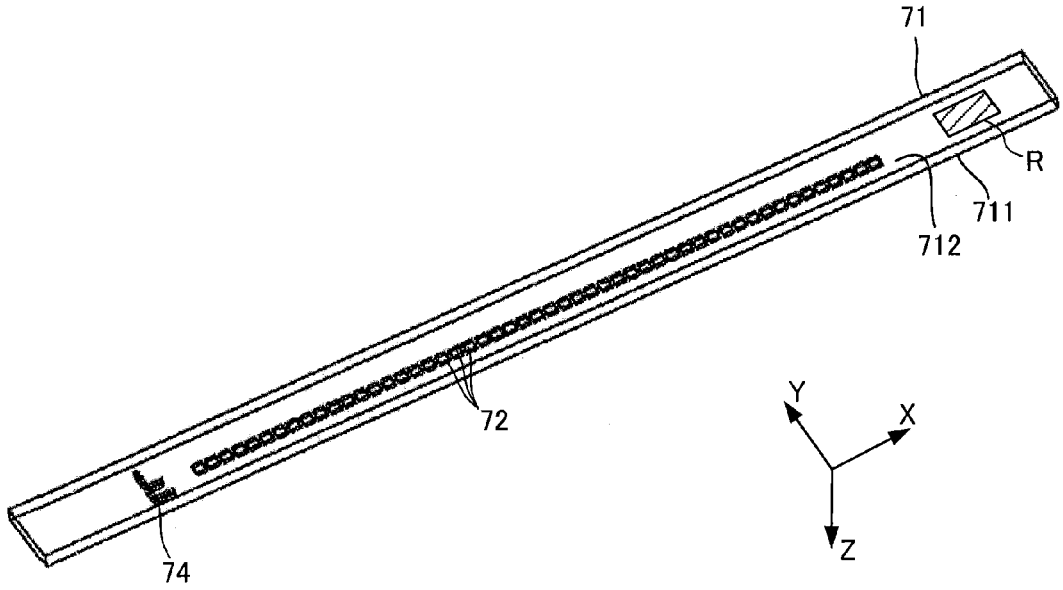
FIG. 5 is a perspective view of a glass substrate which is turned inside out.
Figure 6:
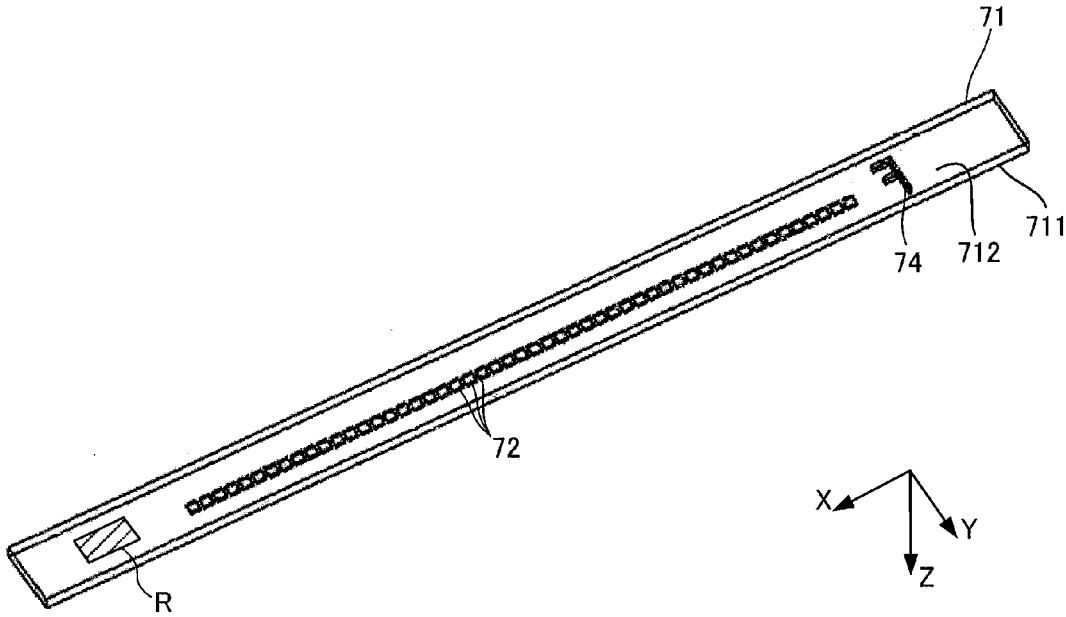
FIG. 6 is a perspective view of the glass substrate of which both ends in a longitudinal direction are conversely positioned compared to that in FIG. 5.

Meanwhile, as shown in FIG. 5, when the glass substrate 71 is turned inside out, the mark 74 is not viewed as the F, and is not the meaningful shape. As long as the glass substrate 71 is turned inside out, as shown in FIG. 6, even when the posture of the glass substrate 71 in FIG. 5 becomes a posture in which both ends thereof are reversed in a longitudinal direction, without being turned inside out, the mark 74 is not viewed as the F, and is not the meaningful shape. Accordingly, the mark 74 allows the worker to recognize the plane 712 in which the mark is not meaningful even when both ends of the glass substrate 71 in a longitudinal direction are reversed, as the rear surface 712.

The sealing panel 75 (FIG. 2) is layered on the glass substrate 71. The sealing panel 75 covers the light emitting element 72, the metal wiring 73, and the mark 74, and seals the members 72 to 74 between the sealing panel and the glass substrate 71.

In the embodiment, the worker can easily understand the plane 711 in which the mark 74 has a meaningful shape (the mark 74 has a normal posture) as the front surface 711, since the mark 74 is visible from any plane 711 and 712 of the light emitting panel 7 (the glass substrate 71), and the mark 74 is asymmetric vertically and horizontally. In addition, the worker can easily understand whether or not both ends of the light emitting panel 7 in a longitudinal direction (up and down) are positioned correctly, on the basis of the up and down direction of the mark 74.

In addition, in the embodiment, since the mark 74 is formed of the same material as that of the metal wiring 73, the mark 74 can be formed at the same time and with the same thickness as the metal wiring 73.

As described above, in the embodiment, it is possible to allow the worker to easily recognize the direction of light emitting panel 7 without increasing the number of processes and cost in respect to the basic design, and without drastically changing the basic design.

Second Embodiment

Figure 7:
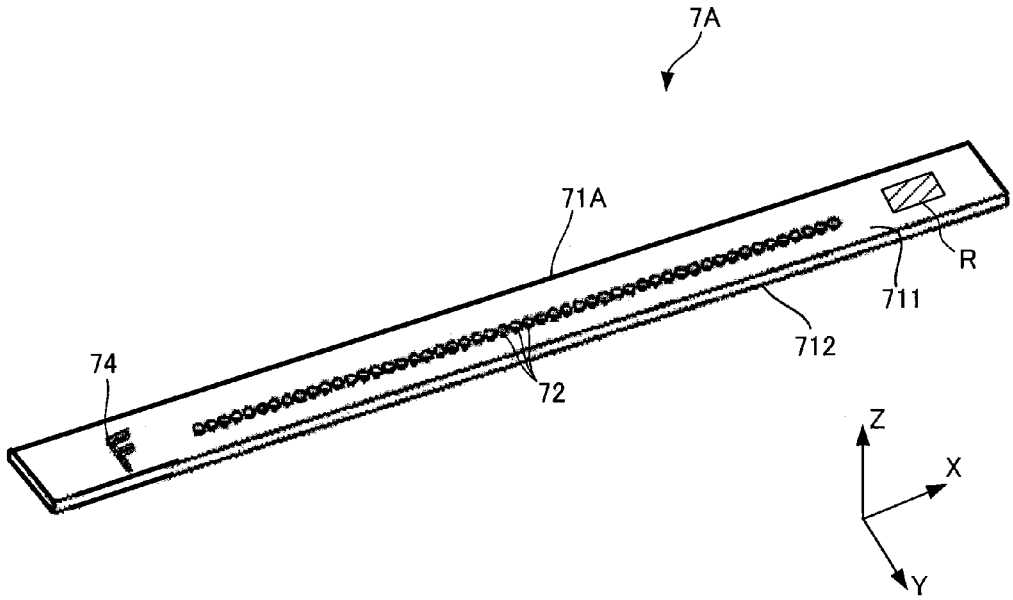
FIG. 7 is a perspective view of the glass substrate.

FIG. 7 is a perspective view of a glass substrate 71A.

In the first embodiment, the light emitting element 72 is disposed at the center of the glass substrate 71 in a transverse direction (Y direction); however, in the embodiment, a light emitting element 72 is positioned to be biased to one side which is a lower-middle side in FIG. 7, in a transverse direction of the glass substrate 71A.

In the embodiment, when the worker understands in advance that a posture of a light emitting panel 7A, in which the light emitting element 72 is positioned downward, is a posture in which both ends of the light emitting panel 7A in a longitudinal direction are at the correct position, the worker can recognize whether or not both ends of the light emitting panel 7A in a longitudinal direction, are at the correct position, depending on whether the light emitting element 72 is on the upper side, or is on the lower side of the light emitting panel 7A, in addition to a posture of the mark 74.

Third Embodiment

Figure 8:
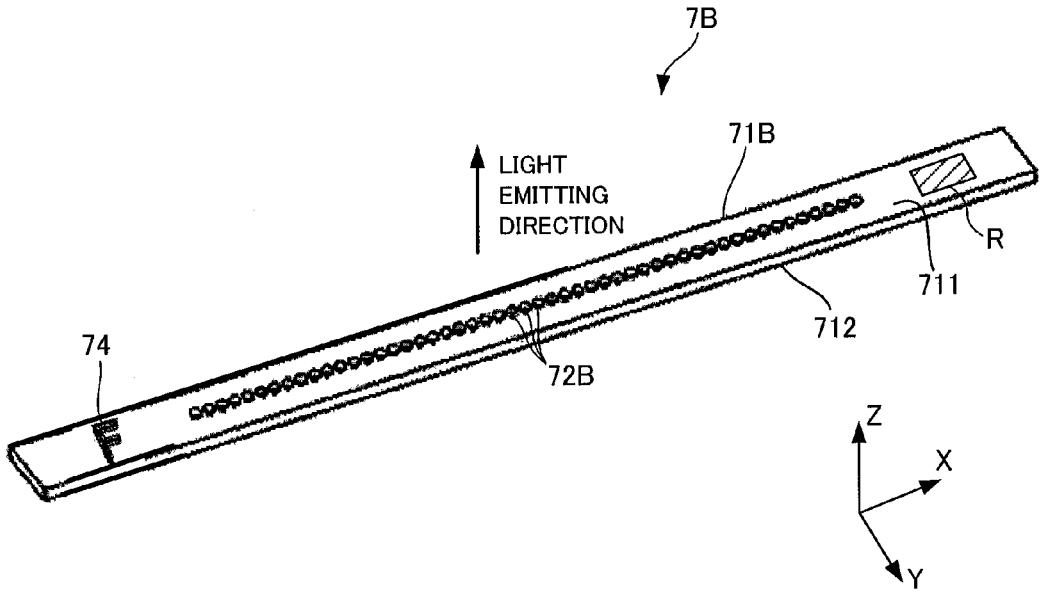
FIG. 8 is a perspective view of the glass substrate.

FIG. 8 is a perspective view of a glass substrate 71B.

In the embodiment, a light emitting element 72 and a mark 74 are disposed on a plane 712 (a rear surface) in a depth side of the glass substrate 713 in FIG. 8. The light emitting element 72 is a bottom emission-type which emits light to the glass substrate 71B. Accordingly, in the embodiment, the plane 711 in which the light emitting element 72 and the mark 74 are not present, and which is a light emitting plane, becomes a front surface 711, in the glass substrate 71B. In addition, in the glass substrate 71B, the plane 712 in which the light emitting element 72 and the mark 74 are present, and light is not emitted, becomes the rear surface 712.

In the embodiment, as shown in FIG. 8, the mark 74 has a meaningful shape when the mark 74 is viewed from the front surface 711 which is a light emitting plane with no mark 74, and the plane 711 with no mark 74 can be recognized as the front surface 711 by the worker.

Modified Example

In each of the embodiments, the light emitting element 72 is an Organic Electro Luminescence element; however, the light emitting element 72 may be a Light Emitting Diode or an Inorganic Electro Luminescence element.

In each of the embodiments, a plurality of light emitting elements 72 is aligned in one line on the glass substrate 71, 71A or 71B; however, the plurality of light emitting elements 72 may aligned in two or more lines on the glass substrate 71, 71A or 71B.

The light emitting element 72 may be transparent or colored in a state of not being applied with voltage. The glass substrate 71, 71A or 71B is not necessarily transparent, or may be colored, when the light emitting element 72 is the top emission-type.

The mark 74 may be positioned at an arbitrary position.

In each of the embodiments, the mark was asymmetric vertically and horizontally; however, the mark may be asymmetric in any of a vertical direction and a horizontal direction, such as T, E, or the like. Even in this case, the worker can recognize the correct direction of the light emitting panel from the relationship with the other portions of the light emitting panel, for example, the light emitting element. A case may be considered in which the worker understands in advance that the posture of the mark which is on the left side of the light emitting element 72, is the correct posture of the light emitting panel 7, and the mark is asymmetric in any of the vertical direction and the horizontal direction such as T or E. In this case, the worker first sets the mark of the light emitting panel to be on the left side of the light emitting element. In addition, when the mark is viewed as the meaningful shape such as T or E, it is possible to recognize that the plane being seen is the front surface which is the light emitting plane. If the mark is turned inside out, and is not seen as the meaningful shape, the plane being seen is recognized as the rear surface which is not emitting light.

The plane which is not emitting light may be set as the front surface in which the mark is seen to have the normal shape.

The member to be transferred on which images are formed using the image forming apparatus 100 may be an OHP (Overhead Projector), in addition to the sheet.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. A light emitting panel comprising:

a glass substrate through which light passes;

a light emitting element disposed on a first plane of the glass substrate;

metal wiring formed on the first plane or a second plane that is opposite the first plane, and configured to apply voltage to the light emitting element; and a mark formed on one of the planes, the mark being formed of the same material as the metal wiring, the mark being visible when viewing the first plane and when viewing the second plane, the mark indicating a first shape when viewing the first plane and indicating a second shape different from the first shape when viewing the second plane, and the mark being electrically isolated from the light emitting element.

2. The panel according to claim 1, wherein the light emitting element is an electro luminescence element.

3. The panel according to claim 1, wherein the mark is vertically asymmetric.

4. The panel according to claim 1, wherein the mark is horizontally asymmetric.

5. The panel according to claim 1, wherein the mark is vertically and horizontally asymmetric.

6. The panel according to claim 1, wherein the mark indicates a correctly oriented character when viewing the plane on which the mark is formed.

7. The panel according to claim 1, wherein the mark indicates a correctly oriented character when viewing the plane on which the mark is not formed.

8. The panel according to claim 1, wherein the glass substrate has an elongated shape, wherein the light emitting element includes plural elements arranged on the glass substrate along a line that extends in a longitudinal direction, and wherein the mark is separated from the plural elements in the longitudinal direction.

9. The panel according to claim 1, wherein the glass substrate has an elongated shape, and wherein the light emitting element includes plural elements arranged on the glass substrate along a line that extends in a longitudinal direction and positioned away from a center of the glass substrate in a transverse direction.

10. The panel according to claim 1, further comprising:

a cover disposed on one of the planes of the glass substrate, and covering the light emitting elements and the mark.

11. An optical print head comprising:

a glass substrate through which light passes;

a light emitting element disposed on a first plane of the glass substrate;

metal wiring formed on the first plane or a second plane that is opposite the first plane, and configured to apply voltage to the light emitting element;

a mark formed on one of the planes, the mark being formed of the same material as the metal wiring, the mark being visible when viewing the first plane and when viewing the second plane, the mark indicating a first shape when viewing the first plane and indicating a second shape different from the first shape when viewing the second plane, and the mark being electrically isolated from the light emitting element; and a lens array through which light emitted from the light emitting element passes.

12. The print head according to claim 11, wherein the light emitting element is an electro luminescence panel element.

13. The print head according to claim 11, wherein the mark is asymmetric vertically and horizontally.

14. The print head according to claim 11, wherein the mark indicates a correctly oriented character when viewing the plane on which the mark is formed.

15. An image forming apparatus comprising:

an optical print head including a glass substrate through which light passes; a light emitting element disposed on a first plane of the glass substrate; metal wiring formed on the first plane or a second plane that is opposite the first plane, and configured to apply voltage to the light emitting element; a mark formed on one of the planes, the mark being formed of the same material as the metal wiring, the mark being visible when viewing the first plane and when viewing the second plane, the mark indicating a first shape when viewing the first plane and indicating a second shape different from the first shape when viewing the second plane, and the mark being electrically isolated from the light emitting element; and a lens array through which light emitted from the light emitting element passes;

a photo conductor which is exposed by the optical print head; and a developing unit which supplies toner to the photo conductor to form a toner image on the photo conductor.

16. The apparatus according to claim 15, wherein the light emitting element is an electro luminescence element.

17. The apparatus according to claim 15, wherein the mark is asymmetric vertically and horizontally.

* * * * *